US006497080B1

(12) United States Patent
Malcolm

(10) Patent No.: US 6,497,080 B1
(45) Date of Patent: Dec. 24, 2002

(54) Z-STUD STRUCTURAL MEMBER

(76) Inventor: Don Robin Brett Malcolm, Site 06, Comp. 37, R.R. #1, Osoyoos (CA), V0H 1V0

( * ) Notice: Subject to any disclaimer, the term of this patent is extended or adjusted under 35 U.S.C. 154(b) by 0 days.

(21) Appl. No.: 09/762,829

(22) PCT Filed: Jun. 10, 1999

(86) PCT No.: PCT/CA99/00542

§ 371 (c)(1),
(2), (4) Date: Feb. 9, 2001

(87) PCT Pub. No.: WO00/77319

PCT Pub. Date: Dec. 21, 2000

(51) Int. Cl.[7] ..... E04C 2/12

(52) U.S. Cl. ..... 52/731.7; 52/579; 52/730.7; 52/474; 52/690; 52/729.1

(58) Field of Search ..... 52/731.7, 730.7, 52/579, 474, 690

(56) References Cited

U.S. PATENT DOCUMENTS 4,947,612 A * 8/1990 Taylor et al. ..... 52/693
5,144,785 A * 9/1992 Berglund ..... 52/730
5,189,860 A * 3/1993 Scott ..... 52/729
5,483,777 A * 1/1996 Menchetti et al. ..... 52/481.1
D401,839 S * 12/1998 Krey et al. ..... D8/354
6,167,675 B1 * 1/2001 LeBlane ..... 52/737.3

FOREIGN PATENT DOCUMENTS

CS 000080770 B * 7/1951 ..... 52/730.7
FR 001230119 A * 9/1960 ..... 52/730.7

* cited by examiner

*Primary Examiner*—Carl D. Friedman
*Assistant Examiner*—Christy Green

(57) ABSTRACT

A structural member "(10)" comprises a generally Z-shaped cross section. Two flange members (14, 16) are bonded to opposite sides and opposite ends of a diagonal web "(12)". Each flange member "(14, 16)" has one surface "(28)" which is bonded to the web "(12)" and at least two additional surfaces "(30, 32)" at right angles to one another. The cross section of the web is six sided, each end of the cross section including a side which is continuous with one of the right angled sides of its associated flange member and another side which acts as a side load bearing surface for the structural member.

11 Claims, 5 Drawing Sheets

Z-STUD STRUCTURAL MEMBER

TECHNICAL FIELD OF THE INVENTION

This invention relates to structural members adapted to be used as beams, joists, studs, posts, lintels, columns or as base and top plate members.

BACKGROUND OF THE INVENTION

It is known to provide composite structural members designed to reduce the amount of solid wood fiber used and to improve the load bearing capacity of the member, as compared to solid lumber. U.S. Pat. No. 5,079,894 to Lau discloses such a structural member having a X-shaped cross section and comprising two isosceles triangle-shaped flanges bonded to opposite sides and ends of parallelogram-shaped web.

However, Lau's use of wedge-shaped flanges and a parallelogram-shaped web limits the load bearing capacity of the member on two of its four sides as such loads are borne on the narrow longitudinal edges of the flanges and web. This in turn limits the ability to use the member in horizontal load bearing applications, or to effectively combine several such members in side by side relationship to form multi-unit composite members such as would be useful for example to produce posts or columns.

Lau also suggests that the flanges of the structural member may be produced simply by diagonally (WORD USED BY LAU) halving 2×3 or 2×4 lumber to produce two isosceles triangular wedges. But in fact, more than one cut would be required to do so. As a result, fabrication of the structural member is not as simple as Lau suggests, nor is it as cost effective as is the present invention in terms of manufacturing steps or the volume of solid wood fibre consumed per unit.

It is therefore an object of the present invention to provide an improved composite structural member made of wood or wood fibre products wherein economical use of solid wood fibre is made and which is relatively easy to manufacture. It is yet a further object of the invention to provide a simple method of producing a composite structural member from solid lumber having standard dimensions.

It is a further object of the invention to provide a composite structural member which has good load bearing capacity on substantially all of its sides and which is capable to being combined with other such members into a multi-unit member.

It is yet a further object of the invention to provide a useful cross sectional profile of a structural member which may selectively be made using materials other than wood or using a combination of wood and such other materials.

SUMMARY OF THE INVENTION

According to the preferred embodiment of die invention, a structural member is provided comprising a generally Z-shaped cross section. Two flange members are bonded to opposite sides and opposite ends of a diagonal web. Preferably, the flange members and the diagonal web are made of wood or wood fibre products and "the flange" members are cut from standard dimensional lumber.

Each flange member has one surface which is bonded to the web and at least two additional surfaces at right angles to one another. The cross section of the web is six sided, each end of the cross section including a side which is continuous with one of the right angled sides of its associated flange member and another side which acts as a side load bearing surface for the structural member.

In another aspect of the invention, the structural member has a cross sectional profile which is defined within an imaginary rectangle, and has a diagonal web member and two flange members disposed on opposite sides of the web member. Each of the flange members has two sides which are coplanar with the sides of the imaginary rectangle and the web portion has at least four surfaces which are coplanar with the sides of the imaginary rectangle.

In another of its aspects, the invention comprises a composite assembly of such structural members secured in side by side relationship. This is particularly useful when each structural member has a cross sectional profile whose longer side has a length which is an even multiple of the length of its shorter side.

According to a method of making the structural member according to the invention, a piece of solid lumber having a rectangular cross-section is sectioned so as to produce at least two equal segments. Each has interior angles consisting of two right angles, one acute angle and one obtuse angle. An elongated web having a generally rectangular cross section and two opposed planar surfaces is provided. Two longitudinal cuts are made obliquely across the planar surfaces of the web substantially at one edge of the web. The two cuts are at a right angle to one another. Two additional longitudinal cuts are made obliquely across said planar surfaces substantially at the other edge of the web. They too are at a right angle from one another. The at least two equal segments are then bonded to opposite sides and opposite ends of said web.

The sectioning step described above may in fact produce only two equal segments by performing a single longitudinal oblique cut through the central longitudinal axis of the lumber. Four or more equal segments may also be obtained depending on the width of the lumber and the desired dimensions of the resulting structural member. In the case of four equal segments, the sectioning step of the method comprises the steps of:

- longitudinally sectioning said piece of lumber into two equal pieces each having a rectangular cross section;
- longitudinally sectioning each of said two equal pieces with an oblique cut so as to produce four of said equal segments.

The present invention minimizes the use of solid wood, presents good side load and end load bearing capacity, allows composite structural members to be produced and provides the advantage of ease of manufacture with a minimum number of cuts.

In another of its aspects, the invention comprises an elongated, integrally formed structural member having cross section comprising a diagonal web portion having major opposed planar surfaces, and two edge portions extending along opposite lateral edges of said web member, characterized in that each of said edge portions comprises two parallel and spaced surfaces extending in a same direction from said web portion, and a third surface extending perpendicularly to said two parallel between the ends of said two parallel surfaces. The web portion includes at least two surfaces which are parallel to said third surfaces.

Other aspects of the invention will be appreciated by reference to the description of the preferred embodiments which follows and to the claims.

BRIEF DESCRIPTION OF THE DRAWINGS

The invention may be more fully appreciated by reference to the following description of the preferred embodiments thereof in conjunction with the drawings wherein.

DETAILED DESCRIPTION OF THE BEST MODE AND PREFERRED EMBODIMENTS

Figure 1:
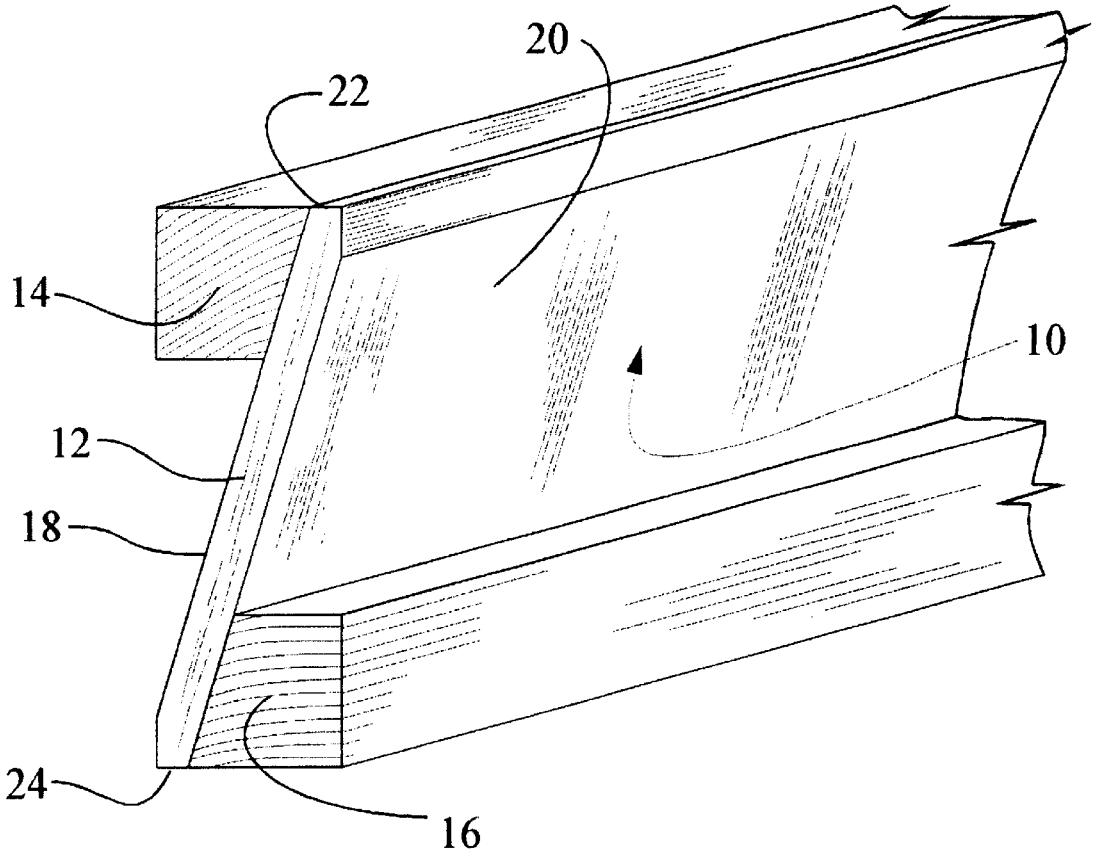
FIG. 1 is a perspective view of a structural member according to the preferred embodiment of the invention.

FIG. 1 is a perspective view of the structural member 10 according to the preferred embodiment of the invention. The structural member 10 generally comprises an elongated web 12 and taco elongated flanges 14 and 16. The two flanges 14 and 16 are disposed at opposite sides 18, 20 and opposite ends 22, 24 of the web 12, which is disposed diagonally. The flanges 14, 16 are bonded to the web 12, preferably by an adhesive.

The web 12 and flanges 14, 16 are preferably made of wood or a wood based composite, such as oriented strand board, plywood, particleboard, etc. In the preferred embodiment, the web is made of oriented strand board and the flanges are cut from solid dimensional lumber.

Figure 2:
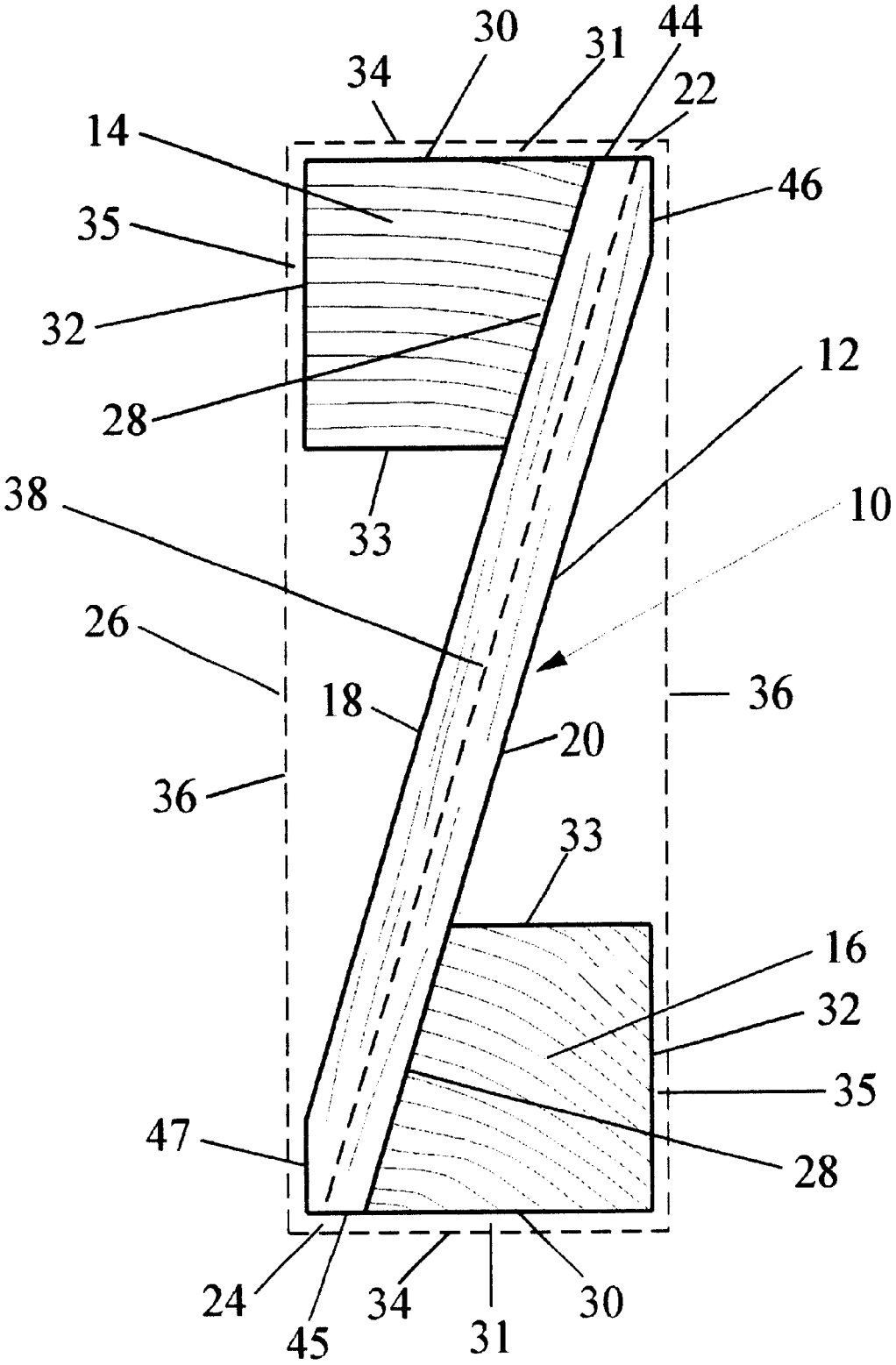
FIG. 2 is a cross sectional view of a structural member according to the preferred embodiment of the invention.

The structural member 10 presents a generally Z-shaped cross section, as best appreciated by reference to FIG. 2. The overall cross section of the structural member 10 is defined within an imaginary rectangle 26, shown in dashed lines. For greater clarity and the imaginary rectangle has been shown as slightly enlarged.

The cross section profile of each of flanges 14, 16 is in the shape of a obliquely truncated rectangle, i.e. a quadrilateral having interior angles consisting of two right angles, an acute angle and an obtuse angle. Each flange 14, 156 has an oblique surface 28 which is bonded to the web and two additional surfaces 30, 32 disposed at right angles to one another. "The right-angled" surfaces 30, 32 are co-planar with two of the sides 34, 36 of the imaginary rectangle 26. A filer surface 33 is parallel to surface 30.

The surface 30 defines the majority of the end surface 31 of the structural member 10. Surface 32 forms a portion of the side surface 35 of the structural member. The oblique surface 28 is at an acute angle to surface 30. The surface 33 is parallel to surface 30, is shorter than surface 30 and 28 and is at an obtuse angle to surface 28. Surface 32 is perpendicular to surfaces 30 and 33 and is shorter than surfaces 30 and 33.

The web includes two major planar and opposed parallel surfaces 18, 20. The cross sectional profile of the web 12 is six sided, and more particularly is in the shape of an elongated two right angled hexagon. The cross section of the web 12 is defined about a lateral axis 38 while the longitudinal axis of the web extends into FIG. 2. Each lateral edge 22, 24 of the web includes a surface 44 which is co-planar with one of the right angled surfaces, namely surface 30. Lateral edges 22, 24 form part of the end surface 31 of the structural member. The web also includes another surface 46 which is perpendicular to surface 44, forms part of side surface 35 and acts as a side load bearing surface for the structural member. It will be appreciated that surfaces 44 and 46 are co-planar with two of the sides of the imaginary rectangle 26. Similarly surfaces 30, 32 of the flanges are also co-planar with two sides of the imaginary rectangle 26.

Construction of Structural Member

Figure 4A:
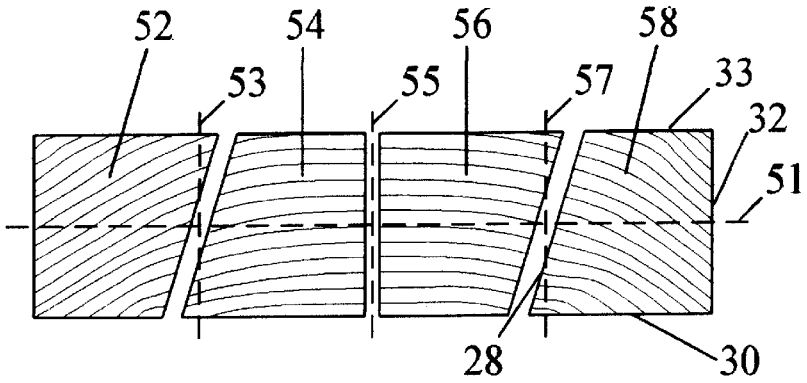
FIG. 4*a* is a cross section diagram of the cuts to be applied to a nominal 2×6 piece of lumber according to the preferred embodiment of the method invention.

The structural member 10 may be economically produced by providing an elongated piece of solid dimensional lumber having a rectangular cross-section, and obliquely cutting it along its length so as to derive four equal segments 52, 54, 56 and 58, as shown On FIG. 4*a*. Such an approach uses the entire piece of lumber and therefore involves no wastage of wood. Segments 52, 54, 56 and 58 will act as flanges for two structural members 10 as shorn in FIG. 4*c*.

Figure 4B:
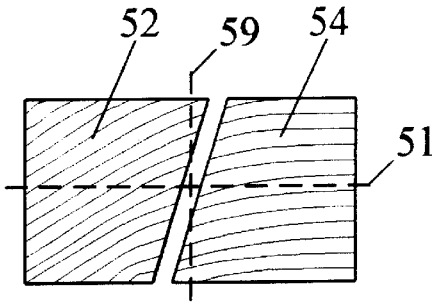
FIG. 4*b* is a cross section diagram of the cut to be applied to a different piece of dimensional lumber.

An elongated piece of dimensional solid lumber having a relatively shorter rectangular cross section than the one illustrated in FIG. 4*a* may be sectioned to produce two equal flange segments 52 and 54 by performing a single oblique cut along the central longitudinal axis of the member, as illustrated in FIG. 4*b*.

Regardless of whether two, three, four or more equal segments are produced from a single piece of dimensional lumber, each of the resulting segments should have interior angles consisting of two right angles, one acute angle and one obtuse angle, so as to be in the form of an obliquely truncated rectangle or an obliquely truncated square.

Figure 5:
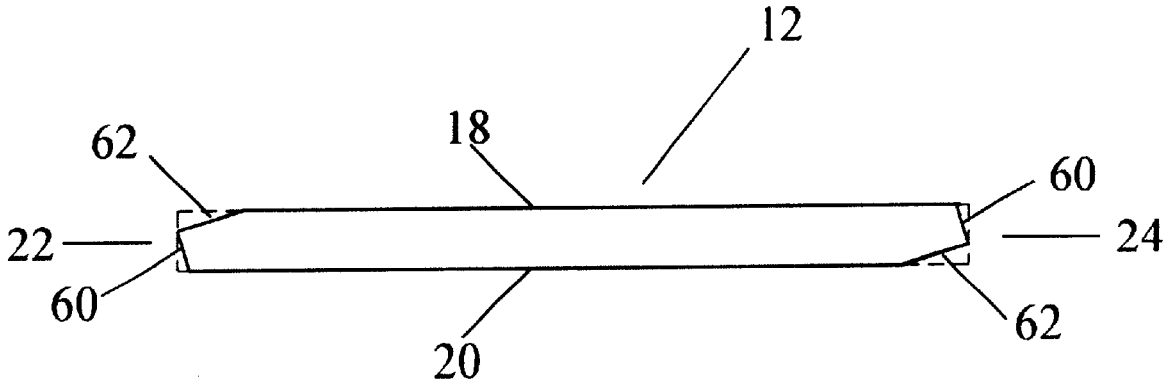
FIG. 5 is a cross section diagram of the cuts to be applied to an otherwise rectangular web member according to the preferred embodiment of the invention.

Referring now to FIG. 5, an elongated web 12 is then provided which has a generally rectangular cross section and two opposed planar surfaces 18, 20. The web 12 is first cut along its length with the cut 60 extending obliquely across the planar surfaces 18, 20. A second lengthwise cut 62 is then made at a right angle to the first cut 60.

Figure 4C:
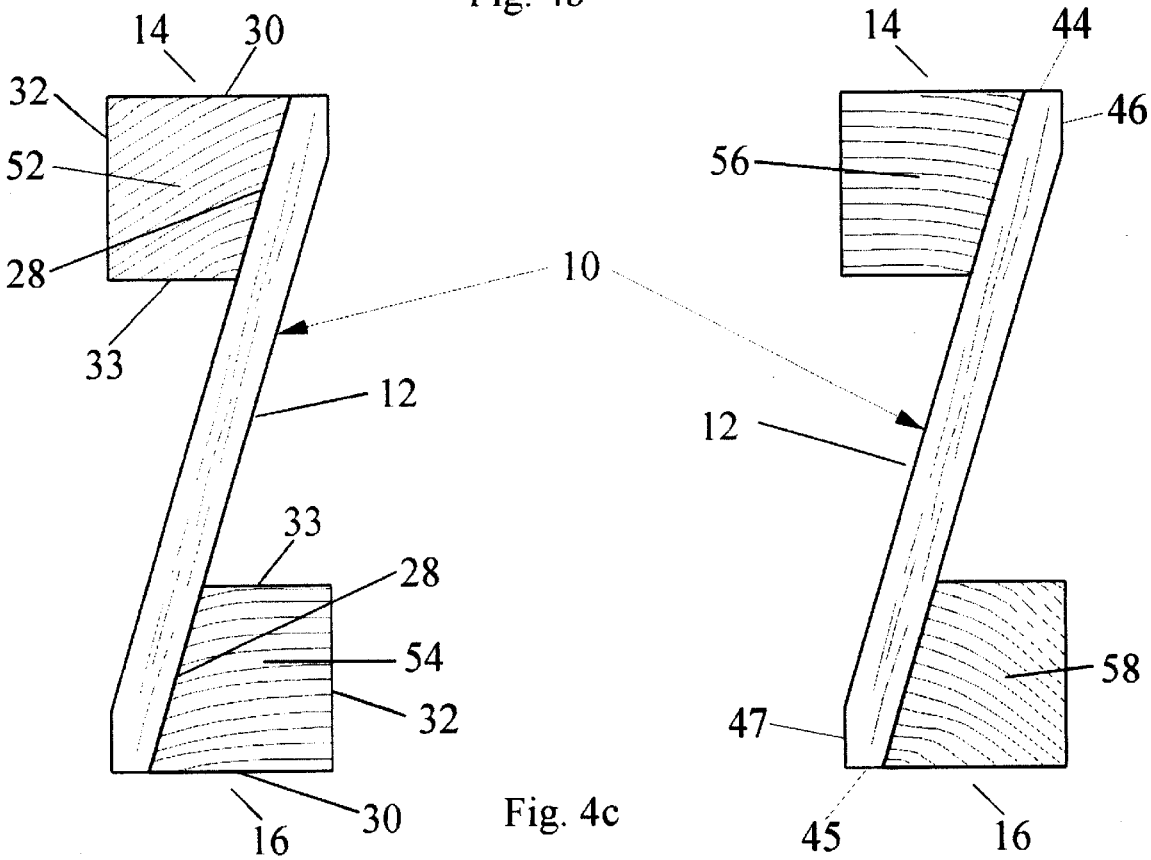
FIG. 4*c* is a cross section view of two composite structural members produced according to the preferred embodiment of the invention.

Referring to FIG. 4*c*, two flange segments are then bonded by adhesive to opposite sides and opposite ends of the web. An alternative approach to cutting the web 12 is to first perform two oblique cuts 60 (corresponding to surface 44 in FIG. 2, bonding the flange elements to the web, then performing cuts 62 (corresponding to surface 46 in FIG. 2) after the bond has set.

Where one piece of lumber is sectioned to produce four flange elements as illustrated in FIG. 4*a*, all four elements can be used to produce two structural members (FIG. 4*c*).

It will be appreciated that this method of constructing the structural member, in conjunction with the particular structure of the flanges and web, allows for easy manufacture, with full use of the lumber used to make the flanges and with a minimum of cuts.

As noted above, the flanges and web member are bonded together using adhesives. Preferably, the bonding surfaces are textured in such manner as to increase the bond surface area between adjacent members. if oriented strand board is used for the web 12, a texturing process allowing for actual deformation through several layers of the web material provides more effective adhesion. In the preferred embodiment of the invention this is accomplished by a knurling process applied to the surfaces of both the web and the flanges which are to be bonded. The knurling preferably extends to a depth of at least a few layers into the oriented strand board and a corresponding depth into the flange member.

The following parameters of the structural member may be varied while still embodying the principles of the invention:

the angle of the web to the vertical and the corresponding angle of the cut of the surface 28 of the Range the width (thickness) of the web the length of the side load bearing surface 44 of the web the length of the right angled sides 30, 32 of the flanges These parameters are largely interdependent.

The following provides a specific example of the dimensions involved in the preferred embodiment of the invention. A nominal lumber size in North America is 2×6. FIG. 4*a* illustrates the cuts applied to a nominal 2×6 piece of lumber. Looking at the butt end and orienting the section as shown in FIG. 4*a* the actual dimensions of the section prior to cutting are approximately 1.5 inches high and 5.5 inches wide. The most practical embodiment of the invention using nominal 2×6 lumber as a source of material for the flanges is to produce a structural member having a cross section defined within an imaginary rectangle having a height of 1.833 inches and a width of 5.5 inches. In order to make the flanges, the 2×6 lumber is longitudinally ripped three times at angles of 17.0, 0 and 17.0 degrees to the vertical as shown in FIG. 4*a* such that each resulting flange section has a surface 32 having a length of 1.5 inches, a surface 30 having a length of 1.529 inches and a surface 33 having a length of 1.070 inches. The cuts are made such that the centre of the saw kerf passes through the intersections of an imaginary horizontal bisecting line 51 and three vertical quadrasecting lines 53, 55 and 57.

A first vertical cut at 0 degrees to the vertical bisects the 2×6 such that the centre of the saw kerf passes through the intersection of the imaginary horizontal 51, and ,vertical medial lines 55, to yield two elongated rectangular sections. A second and third angular cuts at 17 degrees, are made such that the centre of the saw kerf passes through the intersections of the imaginary horizontal 51, and vertical medial lines 53 and 57, to produce quaduplicate flange sections 52, 54, 56, 58. Solaces 28 of the resulting sections are then bonded to opposite ends 22 and 24 and opposite faces 18 and 20 of the elongated web sections 12. The resulting composite structural members as shown in FIG. 4*c*, of which there are two, have a web component which is inclined at a 17 degree angle and opposing flange elements of which surfaces 30 and 32 are parallel and coplanar with sides 34 and 36 of the imaginary rectangle 26. It can be readily appreciated that two composite structural members have been made from one solid 2×6 (nominal) piece of lumber and the web material.

A composite structural member can also be made by providing an elongated rectangular section having an approximate height of 1.5 inches and width of 2.75 inches (a nominal size of 2×3) such as is shown in FIG. 4*b*. The lumber section is bisected a such that the centre of the saw kerf passes through the intersection of the imaginary horizontal 51, and vertical 59 medial lines. The two resulting flange elements are bonded, as noted above, to a single web section 12 to produce a single composite structural member having the same dimensions as noted above.

Composite structural members having a nominal size of 2×4, (1.75 inches high by 3.5 inches wide) can also be made from the same source materials as shown in FIGS. 4*a* (2×6) and 4*b* (2×3) by increasing the slope of the angular cut(s) through the medial line intersections from 17.0 degrees to 27.93 degrees. Resulting flange elements, 52, 54, 56 and 58 are bonded to web sections 12 which have been cut such that the width of surface 44 "(see FIG. 2)" is approximately 0.159 inches and surface 46 is approximately 0.50 inches. The resulting composite structural members have a web component which is inclined at a 27.93 degree angle and opposing flange elements of which surfaces 30 and 32 are parallel and coplanar with sides 34 and 36 of the imaginary rectangle 26. Sides 31 would be 1.75 inches wide and sides 35 of the section would be 3.5 inches.

By varying the angle of the cut, the width of surfaces 44 and the height of surfaces 46, a composite structural member of any desired dimension may be obtained from a suitable piece of source material. Further, the process of finger jointing or similar methods may be applied to the flange and web sections so as to create a composite structural member of indefinite length which may then be cut into desired lengths.

Multi-unit Composite Members

Figure 3A:
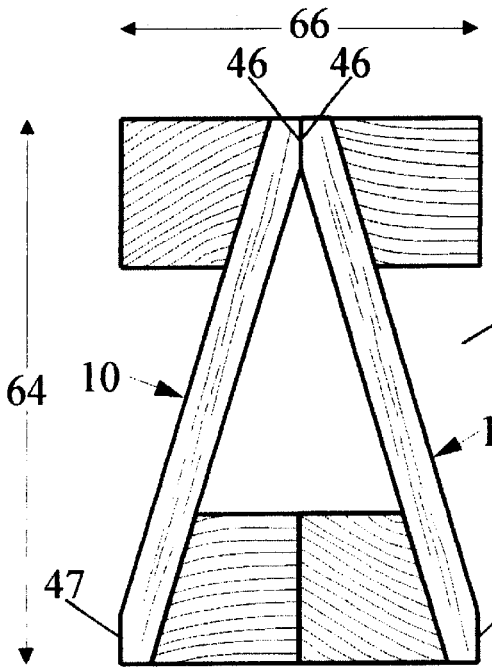
FIG. 3*a* is a cross sectional view of a multi-unit composite structural member according to one embodiment of the invention.
Figure 3B:
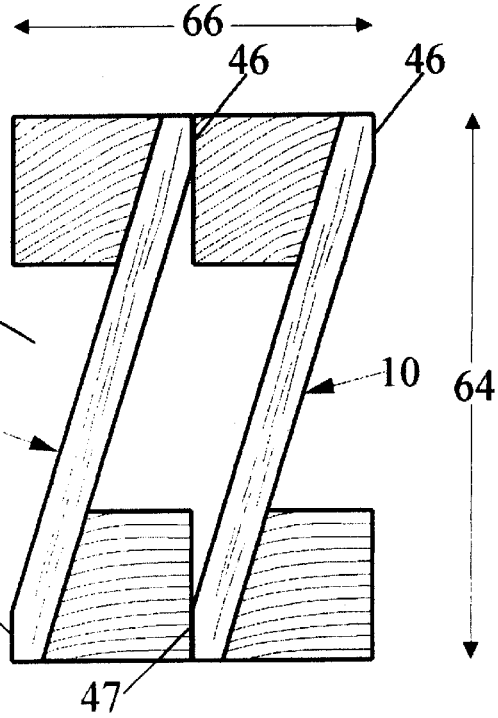
FIG. 3*b* is a cross sectional view of a multi-unit composite structural member according to another embodiment of the invention.
Figure 3C:
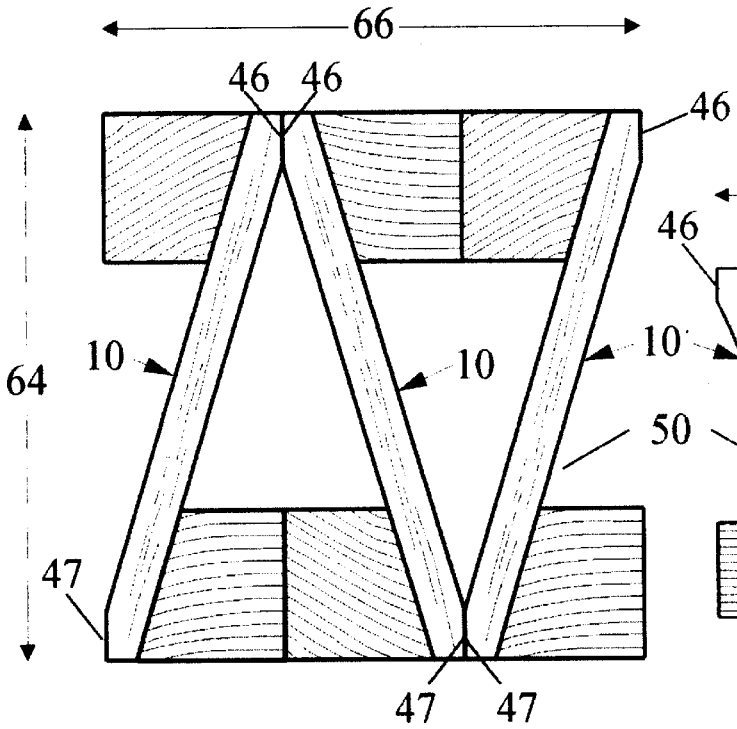
FIG. 3*c* is a cross sectional view of a multi-unit composite structural member according to yet another embodiment of the invention.
Figure 3D:
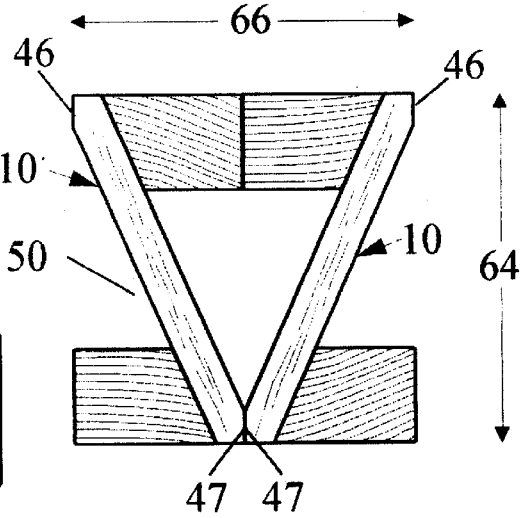
FIG. 3*d* is a cross sectional view of a multi-unit composite structural member according to a further embodiment of the invention.

Two composite members formed by the web and flanges described in the preceding paragraph may be secured in side by side relationship as shown in FIG. 3*a*, 3*b*, 3*c* and 3*d* to produce multi-unit structural members which may serve as a beam, lintle, post or column. The process of combining structural members may be repeated until the required width of beam, etc. is attained. Preferably, the height 35 of the structural member is an even multiple of the width 31. Such even multiple allows the combination of structural members to create composite multi-unit members which are square as shown in FIG. 3*c* and 3*d*. It will be appreciated that planar surfaces 46 provide abutment surfaces for one another, and also act as side load bearing surfaces for the individual structural members. Thus, the individual structural members 10 are well adapted to form such composite multi-unit structural members. FIG. 3*b* illustrates a different embodiments composite multi-unit members.

The structural member according to the invention is more resistant to bending when in a vertical application than conventional solid dimensional lumber due to its increased width. It is also lighter in weight as it uses less solid wood fibre.

The configuration of the structural member is such that the bulk of the mass is concentrated at the extremities of the section. This is advantageous in that the section's moment of inertia, for an equivalent size of structural member to that of the X-beam disclosed in U.S. Pat. No. 5,079,894, is equivalent while consuming less solid wood fibre.

As compared for example to the X-beam disclosed in U.S. Pat. No. 5,079,894, which in its preferred embodiment would use a total of 63 cubic inches of solid wood per linear foot of structural member, the structural member of the invention uses 49.5 cubic inches of solid wood per linear foot of structural member based on the embodiment of the invention illustrated in FIG. 2, using standard dimensional 2×6 lumber.

As the flange elements may usually be cut from standard dimensional lumber to yield an equal number of flange sections with little or no wastage, utilization of wood fibre is maximized. Further, round logs may be cut in such a fashion so as to produce flange sections such as those shown in FIG. 4*b* from areas of the round log that otherwise would be waste.

The advantages of the structural member described herein may also be achieved with flanges and a web made from materials other than wood or wood composites. In addition, the cross sectional Z-shaped profile of the structural member according to the invention -may also be usefully applied to a unitary member wherein the flanges and web described herein are integrally formed, for example out of a single material. Such a member is characterized by comprising a diagonal web portion having major opposed planar surfaces. Two edge portions extends along opposite lateral edges of said web member. Each of said edge portions comprises two parallel and spaced surfaces extending in a same direction from said web portion, and a third surface extending perpendicularly to said two parallel between the ends of said two parallel surfaces. The web portion includes at least two surfaces which are parallel to said third surfaces.

It will be appreciated by those skilled in the art that modifications and variations may be practised on the preferred embodiments described herein without nonetheless departing from the principles of the invention or the intended scope of the claims.

What is claimed is:

1. A structural member having a diagonal web member having major opposed planar surfaces, and two flange members bonded to respective ones of said major surfaces along opposite lateral edges of said web member, characterized in that:

each of said flange members comprising a first surface bonded to one of said major surfaces, second surface at an acute angle to said first surface, a third surface at a right angle to said second surface, and a fourth surface parallel to said second surface;

said web member has a six-sided cross section, and comprising said major opposed planar surfaces, a third web surface which is coplanar with said second surface of a first one of said flange members, a fourth planar web surface at a right angle to said third web surface, a fifth planar web surface which is coplanar with said second surface of a second one of said flange members, and a sixth planar web surface at a right angle to said fifth web surface.

2. A structural member having a diagonal web member having major opposed planar surfaces, and two flange members bonded to respective ones of said major surfaces along opposite lateral edges of said web member, said structural member having a cross-sectional profile defined within an imaginary rectangle, characterized in that:

the cross sectional profile of each of said flange members has two sides which are coplanar with the sides of said imaginary rectangle and the cross sectional profile of said web member has four sides which are coplanar with the sides of said imaginary rectangle.

3. A structural member as in claim 1 wherein said third surface is shorter than said first surface.

4. A structural member according to claim 1, 2 or 3 further characterized in that said flanges and said web are made of wood or wood composite materials.

5. A composite assembly of structural members according to claim 1, 2, 3 or 4 comprising at least two of said structural members secured to one another in side by side relationship.

6. A composite assembly according to claim 5 wherein the cross sectional profile of each structural member has a length which is approximately an even multiple of its width.

7. A method of making a composite structural member comprising the steps of:

sectioning a piece of solid lumber having a rectangular cross-section so as to produce at least two equal segments, each of said segments having interior angles consisting of two right angles, one acute angle and one obtuse angle, providing an elongated web having a generally rectangular cross section and two opposed planar surfaces;

performing two longitudinal cuts extending obliquely across said planar surfaces substantially at one edge of the web, said cuts being at a right angle to one another;

performing two additional longitudinal cuts extending obliquely across said planar surfaces substantially at the other edge of the web, said two additional cuts being at a right angle to one another;

bonding by adhesive said at least two equal segments to opposite sides and opposite ends of said web.

8. The method of claim 7 further characterized in that said step of sectioning comprises only the step of performing a single longitudinal oblique cut through the central longitudinal axis of the lumber.

9. The method of claim 7 wherein said step of sectional said piece of lumber into at least two equal segments comprises the steps of:

longitudinally sectioning said piece of lumber into two equal pieces each having a rectangular cross section;

longitudinally sectioning each of said two equal pieces with a oblique cut so as to produce four of said equal segments.

10. The method according to claim 7 wherein said second and fourth longitudinal cuts are performed after said step of bonding the segments to the web.

11. An elongated, integrally formed structural member having cross section comprising a diagonal web portion having major opposed planar surfaces, and two edge portions extending along opposite lateral edges of said web member, characterized in that:

each of said edge portions comprises two parallel and spaced surfaces extending in a same direction from said web portion, and a third surface extending perpendicularly to said two parallel between the ends of said two parallel surfaces; and, said web portion includes at least two surfaces which are parallel to said third surfaces.

* * * * *

UNITED STATES PATENT AND TRADEMARK OFFICE

CERTIFICATE OF CORRECTION

PATENT NO. : 6,497,080 B1
DATED : December 24, 2002
INVENTOR(S) : Don Robin Brett Malcolm It is certified that error appears in the above-identified patent and that said Letters Patent is hereby corrected as shown below:

Delete the specification columns 1-8 and substitute therefore the attached specification columns 1-8.

Signed and Sealed this

Twenty-seventh Day of September, 2005

JON W. DUDAS
*Director of the United States Patent and Trademark Office*

Z-STUD STRUCTURAL MEMBER

TECHNICAL FIELD OF THE INVENTION

This invention relates to structural members adapted to be used as beams, joists, studs, posts, lintels, and columns or as base and top plate members.

BACKGROUND OF THE INVENTION

It is known to provide composite structural members designed to reduce the amount of solid wood fiber used and to improve the load bearing capacity of the member, as compared to solid lumber. U.S. Pat. No. 5,079,894 to Lau discloses such a structural member having a X-shaped cross section and comprising two isosceles triangle-shaped flanges bonded to opposite sides and ends of parallelogram-shaped web.

However, Lau's use of wedge-shaped flanges and a parallelogram-shaped web limits the load bearing capacity of the member on two of its four sides as such loads are borne on the narrow longitudinal edges of the flanges and web. This in turn limits the ability to use the member in horizontal load bearing applications, or to effectively combine several such members in side by side relationship to form multi-unit composite members such as would be useful for example to produce posts or columns.

Lau also suggests that the flanges of the structural member may be produced simply by diagonally (WORD USED BY LAU) halving 2×3 or 2×4 lumber to produce two isosceles triangular wedges. But in fact, more than one cut would be required to do so. As a result, fabrication of the structural member is not as simple as Lau suggests, nor is it as cost effective as is the present invention in terms of manufacturing steps or the volume of solid wood fibre consumed per unit.

It is therefore an object of the present invention to provide an improved composite structural member made of wood or wood fibre products wherein economical use of solid wood fibre is made and which is relatively easy to manufacture. It is yet a further object of the invention to provide a simple method of producing a composite structural member from solid lumber having standard dimensions.

It is a further object of the invention to provide a composite structural member which has good load bearing capacity on substantially all of its sides and which is capable to being combined with other such members into a multi-unit member.

It is yet a further object of the invention to provide a useful cross sectional profile of a structural member which may selectively be made using materials other than wood or using a combination of wood and such other materials.

SUMMARY OF THE INVENTION

According to the preferred embodiment of the invention, a structural member is provided comprising a generally Z-shaped cross section. Two flange members are bonded to opposite sides and opposite ends of a diagonal web. Preferably, the flange members and the diagonal web are made of wood or wood fibre products and the flange members are cut from standard dimensional lumber.

Each flange member has one surface, which is bonded to the web and at least two additional surfaces at right angles to one another. The cross section of the web is six sided, each end of the cross section including a side which is continuous with one of the right angled sides of its associated flange member and another side which acts as a side load bearing surface for the structural member.

In another aspect of the invention, the structural member has a cross sectional profile which is defined within an imaginary rectangle, and has a diagonal web member and two flange members disposed on opposite sides of the web member. Each of the flange members has two sides, which are coplanar with the sides of the imaginary rectangle, and the web portion has at least four surfaces, which are coplanar with the sides of the imaginary rectangle.

In another of its aspects, the invention comprises a composite assembly of such structural members secured in side by side relationship. This is particularly useful when each structural member has a cross sectional profile whose longer side has a length, which is an even multiple of the length of its shorter side.

According to a method of making the structural member according to the invention, a piece of solid lumber having a rectangular cross-section is sectioned so as to produce at least two equal segments. Each has interior angles consisting of two right angles, one acute angle and one obtuse angle. An elongated web having a generally rectangular cross section and two opposed planar surfaces is provided. Two longitudinal cuts are made obliquely across the planar surfaces of the web substantially at one edge of the web. The two cuts are at a right angle to one another. Two additional longitudinal cuts are made obliquely across said planar surfaces substantially at the other edge of the web. They too are at a right angle from one another. The at least two equal segments are then bonded to opposite sides and opposite ends of said web.

The sectioning step described above may in fact produce only two equal segments by performing a single longitudinal oblique cut through the central longitudinal axis of the lumber. Four or more equal segments may also be obtained depending on the width of the lumber and the desired dimensions of the resulting structural member. In the case of four equal segments, the sectioning step of the method comprises the steps of:

longitudinally sectioning said piece of lumber into two equal pieces each having a rectangular cross section;

longitudinally sectioning each of said two equal pieces with an oblique cut so as to produce four of said equal segments.

The present invention minimizes the use of solid wood, presents good side load and end load bearing capacity, allows composite structural members to be produced and provides the advantage of ease of manufacture with a minimum number of cuts.

In another of its aspects, the invention comprises an elongated, integrally formed structural member having cross section comprising a diagonal web portion having major opposed planar surfaces, and two edge portions extending along opposite lateral edges of said web member, characterized in that each of said edge portions comprises two parallel and spaced surfaces extending in a same direction from said web portion, and a third surface extending perpendicularly to said two parallel between the ends of said two parallel surfaces. The web portion includes at least two surfaces, which are parallel to said third surfaces.

Other aspects of the invention will be appreciated by reference to the description of the preferred embodiments, which follows, and to the claims.

BRIEF DESCRIPTION OF THE DRAWINGS

The invention may be more fully appreciated by reference to the following description of the preferred embodiments thereof in conjunction with the drawings wherein:

FIG. 1 is a perspective view of a structural member according to the preferred embodiment of the invention;

FIG. 2 is a cross sectional view of a structural member according to the preferred embodiment of the invention;

FIG. 3*a* is a cross sectional view of a multi-unit composite structural member according to one embodiment of the invention;

FIG. 3*b* is a cross sectional view of a multi-unit composite structural member according to another embodiment of the invention;

FIG. 3*c* is a cross sectional view of a multi-unit composite structural member according to yet another embodiment of the invention;

FIG. 3*d* is a cross sectional view of a multi-unit composite structural member according to a further embodiment of the invention;

FIG. 4*a* is a cross section diagram of the cuts to be applied to a nominal 2×6 piece of lumber according to the preferred embodiment of the method invention;

FIG. 4*b* is a cross section diagram of the cut to be applied to a different piece of dimensional lumber;

FIG. 4*c* is a cross section view of two composite structural members produced according to the preferred embodiment of the invention;

FIG. 5 is a cross section diagram of the cuts to be applied to an otherwise rectangular web member according to the preferred embodiment of the invention.

DETAILED DESCRIPTION OF THE BEST MODE AND PREFERRED EMBODIMENTS

FIG. 1 is a perspective view of the structural member 10 according to the preferred embodiment of the invention. The structural member 10 generally comprises an elongated web 12 and two elongated flanges 14 and 16. The two flanges 14 and 16 are disposed at opposite sides of the major surfaces 18, 20 and opposite ends 22, 24 of the web 12, which is disposed diagonally. The flanges 14, 16 are bonded to the web 12, preferably by an adhesive.

The web 12 and flanges 14, 16 are preferably made of wood or a wood based composite, such as oriented strand board, plywood, particleboard, etc. In the preferred embodiment, the web is made of oriented strand board and the flanges are cut from solid dimensional lumber.

The structural member 10 presents a generally Z-shaped cross section, as best appreciated by reference to FIG. 2. The overall cross section of the structural member 10 is defined within an imaginary rectangle 26, shown in dashed lines. For greater clarity and the imaginary rectangle has been shown as slightly enlarged.

The cross section profile of each of flanges 14, 16 is in the shape of a obliquely truncated rectangle, i.e. a quadrilateral having interior angles consisting of two right angles, an acute angle and an obtuse angle. Each flange 14, 16 has an oblique first surface 28 which is bonded to the web and a second and third surface 30, 32 disposed at right angles to one another. The right-angled second and third surfaces 30, 32 are co-planar with two of the sides 34, 36 of the imaginary rectangle 26. A fourth flange surface 33 is parallel to surface 30.

The second surface 30 defines the majority of the end surface 31 of the structural member 10. The third surface 32 forms a portion of the side surface 35 of the structural member. The oblique first surface 28 is at an acute angle to second surface 30. The forth surface 33 is parallel to second surface 30, is shorter than the second surface 30 and the first surface 28 and is at an obtuse angle to the first surface 28. The third surface 32 is perpendicular to the second and fourth surfaces 30 and 33 and may be shorter than, equal to or longer than surface 30 and/or surface 33.

The web includes two major planar and opposed parallel surfaces 18, 20. The cross sectional profile of the web 12 is six sided, and more particularly is in the shape of an elongated two right angled hexagon. The cross section of the web 12 is defined about a lateral axis 38 while the longitudinal axis of the web extends into FIG. 2. Lateral edge 22 of the web includes a third surface 44, which is coplanar with the second surface 30 of the flange 14 as shown in FIG. 2. Similarly, lateral edge 24 includes a fifth surface 45 that is coplanar with the second surface 30 of the flange 16 FIG. 2. Lateral edges 22, 24 form part of the end surface 31 of the structural member. The web also includes a fourth 46 and sixth 47 surface which are perpendicular to surfaces 44 and 45, form part of side surfaces 35 and acts as a side load bearing surface for the structural member. It will be appreciated that surfaces 44,45,46 and 47 are co-planar with two of the sides of the imaginary rectangle 26. Similarly surfaces 30, 32 of the flanges are also co-planar with two sides of the imaginary rectangle 26.

Construction of Structural Member

The structural member 10 may be economically produced by providing an elongated piece of solid dimensional lumber having a rectangular cross-section, bisecting it vertically and obliquely cutting the resulting two pieces along their length so as to derive four equal segments 52, 54, 56 and 58, as shown in FIG. 4*a*. Such an approach uses the entire piece of lumber and therefore involves no wastage of wood. Segments 52, 54, 56 and 58 will act as flanges for two structural members 10 as shown in FIG. 4*c*.

An elongated piece of dimensional solid lumber having a relatively shorter rectangular cross section than the one illustrated in FIG. 4*a* may be sectioned to produce two equal flange segments 52 and 54 by performing a single oblique cut along the central longitudinal axis of the member, as illustrated in FIG. 4*b*.

Regardless of whether two, three, four or more equal segments are produced from a single piece of dimensional lumber, each of the resulting segments should have interior angles consisting of two right angles, one acute angle and one obtuse angle, so as to be in the form of an obliquely truncated rectangle or an obliquely truncated square.

Referring now to FIG. 5, an elongated web 12 is then provided which has a generally rectangular cross section and two major opposed planar surfaces 18, 20. The web 12 is first cut along its length with the cut 60 extending obliquely across the major planar surfaces 18, 20. A second lengthwise cut 62 is then made at a right angle to the first cut 60.

Referring to FIG. 4*c*, two flange segments are then bonded by adhesive to opposite major surfaces and opposite ends of the web. An alternative approach to cutting the web 12 is to first perform two oblique cuts 60 (corresponding to surfaces 44 and 45 in FIG. 2, bonding the flange elements to the web, then performing cuts 62 (corresponding to surfaces 46 and 47 in FIG. 2) after the bond has set.

Where one piece of lumber is sectioned to produce four flange elements as illustrated in FIG. 4*a*, all four elements can be used to produce two structural members (FIG. 4*c*).

It will be appreciated that this method of constructing the structural member, in conjunction with the particular structure of the flanges and web, allows for easy manufacture, with full use of the lumber used to make the flanges and with a minimum of cuts.

As noted above, the flanges and web member are bonded together using adhesives. Preferably, the bonding surfaces are textured in such manner as to increase the bond surface area between adjacent members. If oriented strand board is used for the web 12, a texturing process allowing for actual deformation through several layers of the web material provides more effective adhesion. In the preferred embodiment of the invention this is accomplished by a knurling process applied to the surfaces of both the web and the flanges, which are to be bonded. The knurling preferably extends to a depth of at least a few layers into the oriented strand board and a corresponding depth into the flange member.

The following parameters of the structural member may be varied while still embodying the principles of the invention:

- the angle of the web to the vertical and the corresponding angle of the cut of the surface 28 of the flange
- the width (thickness) of the web
- the length of the side load bearing surfaces 44 and 45 of the web
- the length of the right angled sides 30, 32 of the flanges These parameters are largely interdependent.

The following provides a specific example of the dimensions involved in the preferred embodiment of the invention. A nominal lumber size in North America is 2×6. FIG. 4*a* illustrates the cuts applied to a nominal 2×6 piece of lumber. Looking at the butt end and orienting the section as shown in FIG. 4*a* the actual dimensions of the section prior to cutting are approximately 1.5 inches high and 5.5 inches wide. The most practical embodiment of the invention using nominal 2×6 lumber as a source of material for the flanges is to produce a structural member having a cross section defined within an imaginary rectangle having a height of 1.833 inches and a width of 5.5 inches. In order to make the flanges, the 2×6 lumber is longitudinally ripped three times at angles of 17.0, 0 and 17.0 degrees to the vertical as shown in FIG. 4*a* such that each resulting flange section has a surface 32 having a length of 1.5 inches, a surface 30 having a length of 1.529 inches and a surface 33 having a length of 1.070 inches. The cuts are made such that the centre of the saw kerf passes through the intersections of an imaginary horizontal bisecting line 51 and three vertical quadrasecting lines 53, 55 and 57.

A first vertical cut at 0 degrees to the vertical bisects the 2×6 such that the centre of the saw kerf passes through the intersection of the imaginary horizontal 51, and vertical medial lines 55, to yield two elongated rectangular sections. A second and third angular cuts at 17 degrees, are made such that the centre of the saw kerf passes through the intersections of the imaginary horizontal 51, and vertical medial lines 53 and 57, to produce quadruplicate flange sections 52, 54, 56, 58. First surfaces 28 of the resulting sections are then bonded to opposite ends 22 and 24 and opposite major surfaces 18 and 20 of the elongated web sections 12. The resulting composite structural members as shown in FIG. 4*c*, of which there are two, have a web component which is inclined at a 17 degree angle and opposing flange elements of which second and third surfaces 30 and 32 are parallel and coplanar with sides 34 and 36 of the imaginary rectangle 26. It can be readily appreciated that two composite structural members have been made from one solid 2×6 (nominal) piece of lumber and the web material.

A composite structural member can also be made by providing an elongated rectangular section having an approximate height of 1.5 inches and width of 2.75 inches (a nominal size of 2×3) such as is shown in FIG. 4*b*. The lumber section is bisected a such that the centre of the saw kerf passes through the intersection of the imaginary horizontal 51, and vertical 59 medial lines. The two resulting flange elements are bonded, as noted above, to a single web section 12 to produce a single composite structural member having the same dimensions as noted above.

Composite structural members having a nominal size of 2×4, (1.75 inches high by 3.5 inches wide) can also be made from the same source materials as shown in FIGS. 4*a* (2×6) and 4*b* (2×3) by increasing the slope of the angular cut(s) through the medial line intersections from 17.0 degrees to 27.93 degrees. Resulting flange elements, 52, 54, 56 and 58 are bonded to web sections 12 which have been cut such that the width of surfaces 44 and 45 (see FIG. 2) are approximately 0.159 inches and surfaces 46 and 47 are approximately 0.50 inches. The resulting composite structural members have a web component which is inclined at a 27.93 degree angle and opposing flange elements of which surfaces 30 and 32 are parallel and coplanar with sides 34 and 36 of the imaginary rectangle 26. Sides 31 would be 1.75 inches wide and sides 35 of the section would be 3.5 inches.

By varying the angle of the cut, the width of surfaces 44 and 45 and the height of surfaces 46 and 47, a composite structural member of any desired dimension may be obtained from a suitable piece of source material. Further, the process of finger jointing or similar methods may be applied to the flange and web sections so as to create a composite structural member of indefinite length, which may then be cut into desired lengths.

Multi-Unit Composite Members

Two composite members formed by the web and flanges described in the preceding paragraph may be secured in side by side relationship as shown in FIGS. 3*a*, 3*b*, 3*c* and 3*d* to produce multi-unit structural members which may serve as a beam, lintel, post or column. The process of combining structural members may be repeated until the required width of beam, etc. is attained. Preferably, the height 35 of the structural member is an even multiple of the width 31. Such even multiple allows the combination of structural members to create composite multi-unit members, which are square as shown in FIGS. 3*c* and 3*d*. It will be appreciated that planar surfaces 46 and 47 provide abutment surfaces for one another, and also act as side load bearing surfaces for the individual structural members. Thus, the individual structural members 10 are well adapted to form such composite multi-unit structural members. FIG. 3*b* illustrates a different embodiments composite multi-unit member(s).

The structural member according to the invention is more resistant to bending when in a vertical application than conventional solid dimensional lumber due to its increased width. It is also lighter in weight as it uses less solid wood fibre.

The configuration of the structural member is such that the bulk of the mass is concentrated at the extremities of the section. This is advantageous in that the section's moment of inertia, for an equivalent size of structural member to that of the X-beam disclosed in U.S. Pat. No. 5,079,894, is equivalent while consuming less solid wood fibre.

As compared for example to the X-beam disclosed in U.S. Pat. No. 5,079,894, which in its preferred embodiment would use a total of 63 cubic inches of solid wood per linear foot of structural member, the structural member of the invention uses 49.5 cubic inches of solid wood per linear foot of structural member based on the embodiment of the invention illustrated in FIG. 2, using standard dimensional 2×6 lumber.

As the flange elements may usually be cut from standard dimensional lumber to yield an equal number of flange sections with little or no wastage, utilization of wood fibre is maximized. Further, round logs may be cut in such a fashion so as to produce flange sections such as those shown in FIG. 4*b* from areas of the round log that otherwise would be waste.

The advantages of the structural member described herein may also be achieved with flanges and a web made from materials other than wood or wood composites. In addition, the cross sectional Z-shaped profile of the structural member according to the invention may also be usefully applied to a unitary member wherein the flanges and web described herein are integrally formed, for example out of a single material. Such a member is characterized by comprising a diagonal web portion having major opposed planar surfaces. Two edge portions extend along opposite lateral edges of said web member. Each of said edge portions comprises two parallel and spaced surfaces extending in a same direction from said web portion, and a third surface extending perpendicularly to said two parallel between the ends of said two parallel surfaces. The web portion includes at least two surfaces, which are parallel to said third surfaces.

It will be appreciated by those skilled in the art that modifications and variations may be practised on the preferred embodiments described herein without nonetheless departing from the principles of the invention or the intended scope of the claims.

What is claimed is:

1. A structural member having a diagonal web member having major opposed planar surfaces, and two flange members bonded to respective ones of said major surfaces along opposite lateral edges of said web member, characterized in that:

each of said flange members comprising a first surface bonded to one of said major surfaces, second surface at an acute angle to said first surface, a third surface at a right angle to said second surface, and a fourth surface parallel to said second surface;

said web member has a six-sided cross section, and comprising said major opposed planar surfaces, a third web surface which is coplanar with said second surface of a first one of said flange members, a fourth planar web surface at a right angle to said third web surface, a fifth planar web surface which is coplanar with said second surface of a second one of said flange members, and a sixth planar web surface at a right angle to said fifth web surface.

2. A structural member having a diagonal web member having major opposed planar surfaces, and two flange members bonded to respective ones of said major surfaces along opposite lateral edges of said web member, said structural member having a cross-sectional profile defined within an imaginary rectangle, characterized in that:

the cross sectional profile of each of said flange members has two sides which are coplanar with the sides of said imaginary rectangle and the cross sectional profile of said web member has four sides which are coplanar with the sides of said imaginary rectangle.

3. A structural member as in claim 1 wherein said third surface is shorter than said first surface.

4. A structural member according to claim 1, 2 or 3 further characterized in that said flanges and said web are made of wood or wood composite materials.

5. A composite assembly of structural members according to claim 1 comprising at least two of said structural members secured to one another in side by side relationship.

6. A composite assembly according to claim 5 wherein the cross sectional profile of each structural member has a length which is approximately an even multiple of its width.

7. A method of making a composite structural member comprising the steps of:

sectioning a piece of solid lumber having a rectangular cross-section so as to produce at least two equal segments, each of said segments having interior angles consisting of two right angles, one acute angle and one obtuse angle, providing an elongated web having a generally rectangular cross section and two opposed planar surfaces;

performing two longitudinal cuts extending obliquely across said planar surfaces substantially at one edge of the web, said cuts being at a right angle to one another;

performing two additional longitudinal cuts extending obliquely across said planar surfaces substantially at the other edge of the web, said two additional cuts being at a right angle to one another;

bonding by adhesive said at least two equal segments to opposite sides and opposite ends of said web.

8. The method of claim 7 further characterized in that said step of sectioning comprises only the step of performing a single longitudinal oblique cut through the central longitudinal axis of the lumber.

9. The method of claim 7 wherein said step of sectional said piece of lumber into at least two equal segments comprises the steps of:

longitudinally sectioning said piece of lumber into two equal pieces each having a rectangular cross section;

longitudinally sectioning each of said two equal pieces with an oblique cut so as to produce four of said equal segments.

10. The method according to claim 7 wherein said second and fourth longitudinal cuts are performed after said step of bonding the segments to the web.

11. An elongated, integrally formed structural member having cross section comprising a diagonal web portion having major opposed planar surfaces, and two edge portions extending along opposite lateral edges of said web member, characterized in that:

each of said edge portions comprises two parallel and spaced surfaces extending in a same direction from said web portion, and a third surface extending perpendicularly to said two parallel between the ends of said two parallel surfaces; and, said web portion includes at least two surfaces, which are parallel to said third surfaces.

* * * * *